US009607799B2

(12) United States Patent
Schmidt et al.

(10) Patent No.: US 9,607,799 B2
(45) Date of Patent: Mar. 28, 2017

(54) POROUS INLAY FOR FUSE HOUSING

(71) Applicant: LITTELFUSE, INC., Chicago, IL (US)

(72) Inventors: Florian Schmidt, Harpstedt (DE); Michael Hofmann, Bremen (DE); Pascal Jung, Bremen (DE)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 14/716,268

(22) Filed: May 19, 2015

(65) Prior Publication Data

US 2015/0340188 A1 Nov. 26, 2015

Related U.S. Application Data

(60) Provisional application No. 62/001,924, filed on May 22, 2014.

(51) Int. Cl.

| | |
|---|---|
| ***H01H 85/05*** | (2006.01) |
| ***H01H 85/175*** | (2006.01) |
| ***H01H 69/02*** | (2006.01) |
| ***H01H 85/38*** | (2006.01) |
| *H01H 85/00* | (2006.01) |
| *H01H 85/18* | (2006.01) |

(52) U.S. Cl.

CPC ..... *H01H 85/05* (2013.01); *H01H 69/02* (2013.01); *H01H 85/175* (2013.01); *H01H 85/1755* (2013.01); *H01H 85/38* (2013.01); *H01H 85/0086* (2013.01); *H01H 85/18* (2013.01); *H01H 2085/383* (2013.01); *H01H 2085/388* (2013.01); *Y10T 29/49108* (2015.01)

(58) Field of Classification Search

CPC ..... H01H 85/05; H01H 69/02; H01H 85/175; H01H 85/1755; H01H 85/38; H01H 2085/388; H01H 85/18; H01H 2085/383; H01H 85/0086; Y10T 29/49108

USPC ..... 337/186, 276, 280

See application file for complete search history.

(56) References Cited

U.S. PATENT DOCUMENTS

| | | | | |
|---|---|---|---|---|
| 550,638 A | | 12/1895 | McCulloch | |
| 1,350,055 A | | 8/1920 | Ballman | |
| 1,474,146 A | * | 11/1923 | Feldkamp | H01H 85/38 337/250 |
| 1,480,225 A | * | 1/1924 | Snook | H01H 85/18 218/1 |
| 2,077,282 A | * | 4/1937 | Denault | H01B 7/295 174/102 P |
| 2,143,037 A | * | 1/1939 | Smith, Jr. | H01H 85/42 337/231 |
| 2,483,577 A | | 10/1949 | Fanhoe | |

(Continued)

FOREIGN PATENT DOCUMENTS

| | | |
|---|---|---|
| CN | 102623273 A | 8/2012 |
| GB | 443717 A | 3/1936 |

*Primary Examiner* — Anatoly Vortman

(57) ABSTRACT

A fuse may include a housing having a cavity. The fuse may also include a fuse element disposed within the cavity; a plurality of terminals extending out of the housing and electrically connected to the fuse element; and porous material disposed in the cavity adjacent to the fuse element, the porous material having a plurality of pores, the porous material further comprising an open pore structure wherein at least some of the pores are disposed on an outer surface of the porous material facing the fuse element.

17 Claims, 6 Drawing Sheets

(56) References Cited

U.S. PATENT DOCUMENTS

| | | | | | |
|---|---|---|---|---|---|
| 3,281,557 | A * | 10/1966 | Fister | H01H 85/303 | 337/244 |
| 3,317,689 | A * | 5/1967 | Saudicoeur | H01H 69/02 | 337/246 |
| 3,317,690 | A * | 5/1967 | Hollmann et al. | H01H 69/02 | 337/246 |
| 3,365,559 | A | 1/1968 | Sherwood | | |
| 3,601,737 | A * | 8/1971 | Baird | H01H 85/055 | 337/159 |
| 3,818,409 | A * | 6/1974 | Pastors | H01H 85/0445 | 337/166 |
| 4,100,523 | A * | 7/1978 | Arikawa | H01H 85/38 | 337/163 |
| 4,109,228 | A * | 8/1978 | Wycklendt | H01H 85/18 | 337/276 |
| 4,417,226 | A * | 11/1983 | Asdollahi | H01H 85/165 | 337/273 |
| 4,506,310 | A * | 3/1985 | Schwarz | H01H 85/055 | 261/124 |
| 4,757,296 | A * | 7/1988 | Brown | H01H 85/18 | 337/273 |
| 4,789,512 | A | 12/1988 | Hughes | | |
| 5,095,297 | A * | 3/1992 | Perreault | H01H 85/157 | 337/228 |
| 5,179,436 | A * | 1/1993 | Asdollahi | H01H 85/43 | 337/203 |
| 5,420,560 | A * | 5/1995 | Hanada | H01H 85/18 | 337/273 |
| 2011/0279218 | A1* | 11/2011 | Salonga | H01H 85/08 | 337/187 |
| 2015/0357143 | A1* | 12/2015 | Retardo | H01H 85/185 | 337/231 |
| 2016/0064173 | A1* | 3/2016 | Bukacek | H01H 85/042 | 337/159 |

* cited by examiner

POROUS INLAY FOR FUSE HOUSING

RELATED APPLICATIONS

This application claims priority to U.S. provisional patent application No. 62/001,924, filed May 22, 2014 and incorporated by reference herein in its entirety.

FIELD OF THE DISCLOSURE

This disclosure relates generally to the fuses and particularly to porous inlays for use in a fuse housing.

BACKGROUND OF THE DISCLOSURE

Fuses are commonly used as circuit protection devices. A fuse can provide electrical connections between sources of electrical power and circuit components to be protected. One type of fuse includes a fusible element disposed within a hollow fuse body. Conductive terminals may be connected to different ends of the fusible element through the fuse body to provide a means of connecting the fuse between a source of power and a circuit component.

Upon the occurrence of a specified fault condition in a circuit, such as an overcurrent condition, the fusible element of a fuse may melt or otherwise separate to interrupt current flow in the circuit path. Portions of the circuit are thereby electrically isolated and damage to such portions may be prevented or at least mitigated.

As a fuse element melts, material of the element vaporizes and can deposit inside the fuse housing. This can lead to a low resistance current path between the fuse terminals. Said differently, even when the fuse element has melted and/or separated, the fuse terminals may still be electrically connected via a low resistance through the deposits of the vaporized fuse element on the inside of the fuse housing. These low resistance electrical paths are often referred to as "carbon bridges." As will be appreciated, carbon bridges can allow leakage current to flow between the fuse terminals. As such, when a carbon bridge forms, the fuse does not provide enough insulation resistance to protect the circuit components. Furthermore, as circuit voltage increases, so does the chance or occurrence of carbon bridges. In particular, owing to the high energetic light arc occurring when high voltage fuse elements vaporize, the occurrence of carbon bridges also tends to increase.

As will be appreciated, carbon bridges, and particularly the resulting leakage current, can damage circuit components intended to be protected by the melting of the fuse element. Accordingly, having a high insulation resistance in a fuse after melting of the fuse element is useful. In particular, some standards exist specifying insulation resistance to be greater than a specific value (e.g., >1 MΩ after melting at 70V, or the like) in order for the fuse to be compliant with the standard.

It is with respect to the above the present disclosure is provided.

BRIEF SUMMARY

In one embodiment, a fuse may include a housing having a cavity. The fuse may also include a fuse element disposed within the cavity; a plurality of terminals extending out of the housing and electrically connected to the fuse element; and porous material disposed in the cavity, the porous material having a plurality of pores, the porous material further comprising an open pore structure wherein at least some of the pores are disposed on an outer surface of the porous material facing the fuse element.

In another embodiment, a method of forming a fuse may include providing a fuse structure comprising a fuse element and a first terminal and a second terminal connected to the fuse element; providing a first housing part and a second housing part; providing a porous material between the fuse element and at least one of the first housing part and second housing part; and assembling the first housing part to the second housing part, wherein the first housing part and second housing part define a cavity retaining the porous material. The porous material may have a plurality of pores, and the porous material may further comprise an open pore structure wherein at least some of the pores are disposed on an outer surface of the porous material facing the fuse element.

In a further embodiment a fuse may include a fuse element; a first terminal connected to a first portion of the fuse element; a second terminal connected to a second portion of the fuse element; a housing defining a first cavity region disposed on a first side of the fuse element and a second cavity region disposed on a second side of the fuse element opposite the first side; a first porous piece disposed in the first cavity region; and a second porous piece disposed in the second cavity region. The first porous piece and the second porous piece may include a plurality of pores having an open pore structure wherein at least some pores are disposed on a first outer surface of the first porous piece and a second outer surface of the second porous piece, the first outer surface and second outer surface facing the fuse element.

BRIEF DESCRIPTION OF THE DRAWINGS

By way of example, specific embodiments of the disclosed device will now be described, with reference to the accompanying drawings, where.

DETAILED DESCRIPTION

In general, the present disclosure provides a fuse having a housing disposed around a fuse element. The fuse further includes a porous material (e.g., silicone foam, or the like) disposed in the housing adjacent to the fuse element. During vaporization of the fuse element, portions of the vaporized fuse element may be captured in the pores of the porous material to prevent formation of carbon bridges. More specifically, the vaporized portions of the fuse element may be lodged in the pores of the porous material and thereby prevented from settling on the inside of the fuse housing and forming carbon bridges. As such, fuses according to the present disclosure may be provided having high insulation resistance (e.g., >1 MΩ at 70V for a 48V fuse, or the like) after melting of the fuse element. The example insulation resistance value given above is for purposes of clarity and completeness and is not intended to be limiting.

Figure 1:
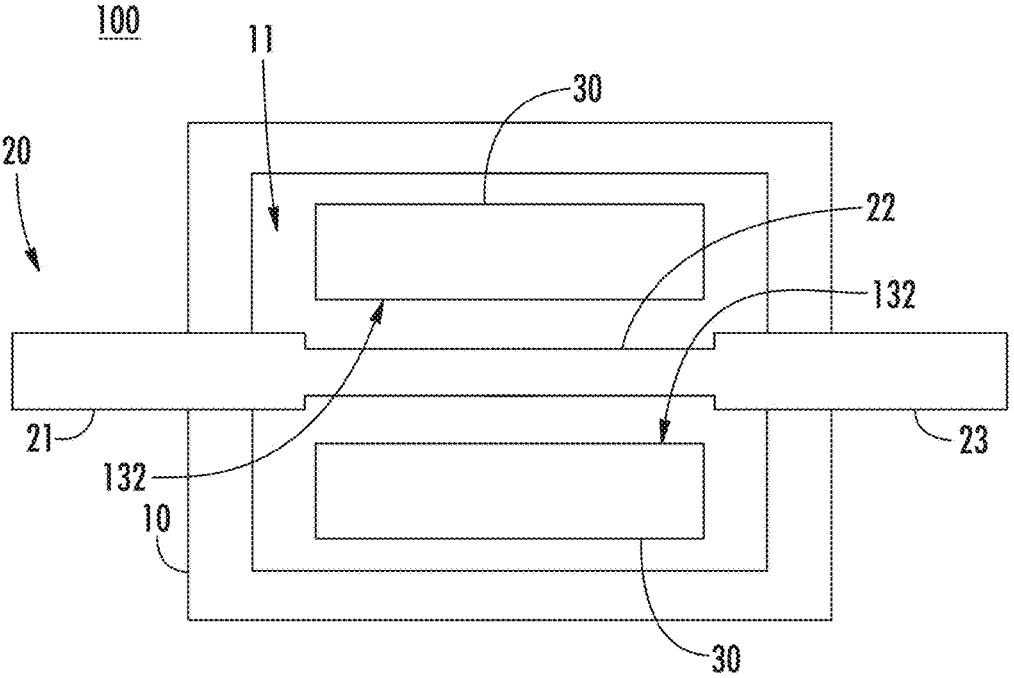
FIG. 1 is a block diagram of a fuse according to embodiments of the present disclosure.

FIG. 1 is a block diagram of a fuse 100 according to embodiments of the present disclosure. As depicted, the fuse 100 includes a housing 10, a conductor 20 and porous material 30. In general, the conductor 20 may be made from a variety of conductive materials (e.g., copper, tin, silver, zinc, aluminum, alloys including such materials, or some combination of these). Furthermore, the conductor includes a terminal 21 and a terminal 23. The terminals 21, 23 are configured to electrically connect the fuse to a source of power (not shown) and a circuit component to be protected (not shown). The terminals 21, 23 are electrically connected by a fuse element 22. In some examples, the terminals 21, 23 and the fuse element 22 may be made from the same material. In some examples, the terminals 21, 23 and the fuse element 22 may be made from different materials. Furthermore, various techniques exist for forming the conductor 20 and/or the terminals 21, 23 and the fuse element 22 (e.g., stamping, cutting, or the like). Furthermore, in the example where the terminals 21, 23 and the fuse element 22 are formed separately, the fuse element 22 and terminals 21, 23 can be joined using a variety of techniques (e.g., soldering, welding, or the like).

The porous material 30 may be a variety of porous materials configured to "catch" or "retain" portions of the fuse element 22 when the fuse element 22 vaporizes due to an overcurrent and/or overvoltage condition. In some examples, the porous material 30 may be silicone foam. In another example, the porous material 30 may be pumice. In some examples, the porous material 30 may be selected based on a variety of factors. For example, the porous material 30 may be selected based on the temperature resistance of the material. In particular, a high temperature resistance material may be useful to resist damage due to exposure to heat generated by the fuse element during normal operation and well as when the element melts. For example, the expected life span of the fuse and the temperature resistance of the material may be used to ensure the porous material 30 does not age prematurely. Additionally, the porous material 30 may be selected based on the flexibility of the material, such as, to allow the material to act as a damper and/or reduce emissions (e.g., vaporized material pushed out of the fuse housing).

In various embodiments, and as shown in particular in FIGS. 3, 4, 6, and 7 to follow, the porous material 30 may have an open pore structure, meaning at least some pores of porous material 30 are disposed on an outer surface(s) of the porous material. In particular, at least some pores may be disposed on the outer surface 132 of a piece of porous material 30 facing the fuse element 22. In this manner, the porous material 30 may present open pores directly facing the fuse element 22. As further detailed below, the porous material 30 may be disposed adjacent the fuse element 22, may be in contact with the fuse element 22, or may be spaced apart from the fuse element 22. In these different configurations pores of the porous material 30 facing the fuse element 22 or proximate the fuse element 22 may receive and retain vaporized or melted portions of the fuse element 22. In various embodiments, the porous material 30 may be disposed as an insert or inlay within a housing of a fuse or may be molded within a housing of the fuse.

In particular, the porous material 30 is configured to provide a large surface area to catch or retain the vaporized portions of the fuse element 22. Said differently, due to the pores (refer to FIG. 3) of the porous material 30, a large surface area relative to the inside surface of the housing 10 or the volume of the fuse element 22 is provided. In other words, the surface area of the porous material 30 may be larger than the surface area of the inside surface of the housing 10. As such, vaporized portions of the fuse element 22 may enter pores of the porous material 30 and may be distributed over the large surface area provided by the porous material 30 to increase the insulation resistance of the fuse 100 after melting of the fuse element 22. More specifically, the larger surface area of the porous material 30 provides a significantly larger area for vaporized portions of the fuse element 22 to be distributed and disposed. As such, the occurrence of carbon bridges may be reduced.

As depicted, the housing 10 includes a cavity 11 where the fuse element 22 and the porous material 30 are disposed. The terminals 21, 23 extend through the housing and are electrically connected to the fuse element 22. In general, the housing 10 may be made from a variety of materials (e.g., plastic, composite, epoxy, or the like). In some examples, the housing 10 may be formed around the conductor 20 and the porous material 30. In some examples, the housing 10 may be multi-part (e.g., refer to FIGS. 2, 4) and the fuse 100 can be assembled by connecting the housing parts once the conductor 20 and the porous material 30 are placed in the cavity 11.

During normal operation, current flows from terminal 21 to terminal 23 through the fuse element 22 (or vice versa). During an abnormal condition, when the fuse element 22 melts, an arc is generated and the fuse element 22 is vaporized. The porous material 30 may be configured and/or selected to flex and or absorb some of the pressure created during the melting of the fuse element 22. More specifically, as the arc burns and vaporizes the fuse element 22, pressure within the housing 10 increases. Known fuses may be prone to rupture due to such pressure. In accordance with various embodiments of the disclosure, a flexible porous material may provide for the absorption of some of the pressure created when the arc burns to reduce and/or prevent rupture of the housing 10 due to the melting of the fuse element 22. In some examples, as stated above, silicone foam may be used as the porous material 30. In particular, silicone foam may provide for the porous material 30 not to degrade during the expected life span of the fuse 100. In other words, the porous material 30 may retain sufficient flexible properties and open pores to absorb and catch vaporized material from the fuse element 22 to prevent or reduce carbon bridges. An additional advantage of silicone foam is because the silicone foam may contain little or no carbon, wherein even in the event the silicone foam decomposes during a fuse event, carbon material is not formed from the foam.

Figure 2:
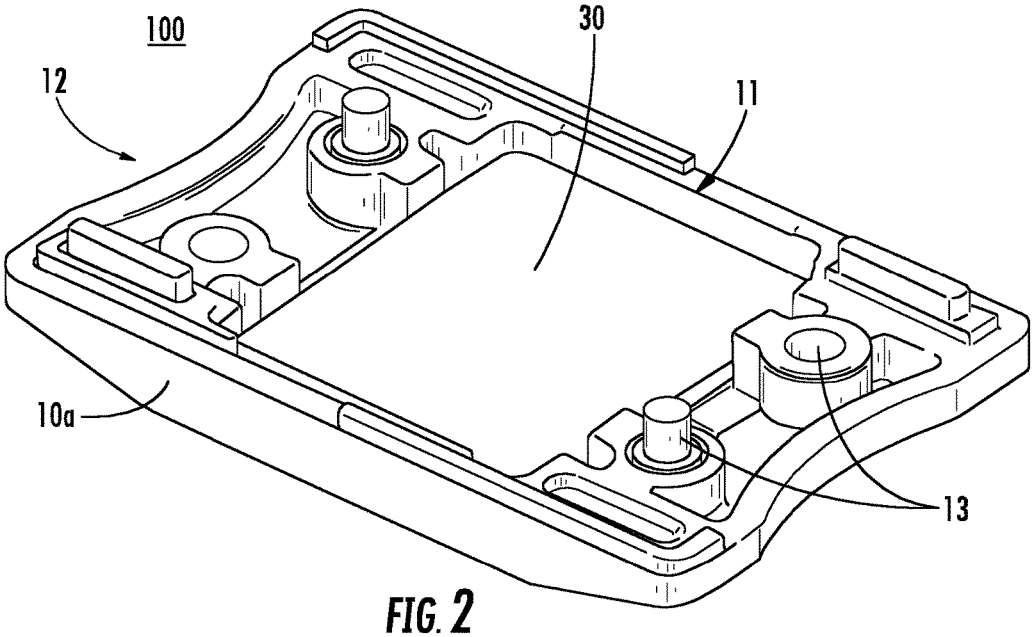
FIG. 2 is perspective view of an example portion of a housing of the fuse of FIG. 1 according to embodiments of the present disclosure.

As described above, the housing 10 may be multiple parts, where the multiple parts are assembled to form the fuse 100. FIG. 2 illustrates an example of a top (or bottom) portion of the housing 10, referred to as housing 10*a*. As depicted, the housing 10*a* includes a cavity 11, where porous material 30 may be disposed. Furthermore, the housing 10*a* includes recessed portions 12. The recessed portions 12 may be configured to allow the terminals 21, 23 to pass through the housing 10 when the housing 10 is assembled. More specifically, when the housing 10*a* is assembled with another housing 10*a* (refer to FIG. 4) the recessed portions 12 may allow the terminals 21, 23 to extend out of the housing 10 to facilitate electrical connection of the fuse 100 to a power source and circuit component.

At least one housing 10*a* may include an alignment component configured to couple to another housing 10*a*. In particular, the housing 10*a* may also include alignment portions 13. As can be seen, the alignment portions 13 are configured to align with one another (e.g., when the housing 10*a* is assembled with another housing 10*a*). The alignment portions 13 may be configured to snap together, and or provide space for epoxy, or the like to be used to secure the housing 10 once assembled. In some examples, the alignment portions 13 may be posts and holes (e.g., as depicted in FIG. 2). In other examples, the alignment portions may be rectangular or polygonal shaped protrusions with corresponding slots or receiving holes.

Figure 3:
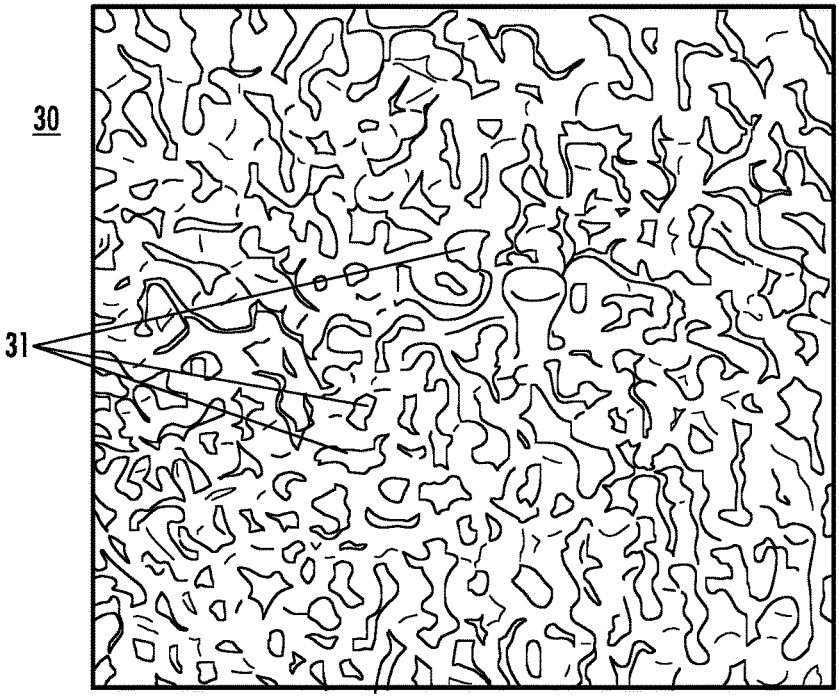
FIG. 3 is an image of an example porous material of the fuse of FIG. 1 according to embodiments of the present disclosure.

FIG. 3 illustrates an example of porous material 30 according to an embodiment of the present disclosure. The porous material 30 includes pores 31. As described above, the pores 31 are configured to increase the surface area available to catch vaporized material of the fuse element 22. In particular, the pores 31 are configured to catch the vaporized material and prevent the material from passing through the porous material and from being disposed on inner surface (inside surface) of the fuse housing, i.e., the housing 10, where the vaporized material if disposed on the inside surface could lead to a carbon bridge being formed and reduced insulation resistance once the fuse element 22 has melted. Said differently, the pores 31 are configured to trap and or retain the vaporized particles (e.g., refer to FIG. 5*b*) of the fuse element 22 in the event the fuse element 22 melts.

Figure 4:
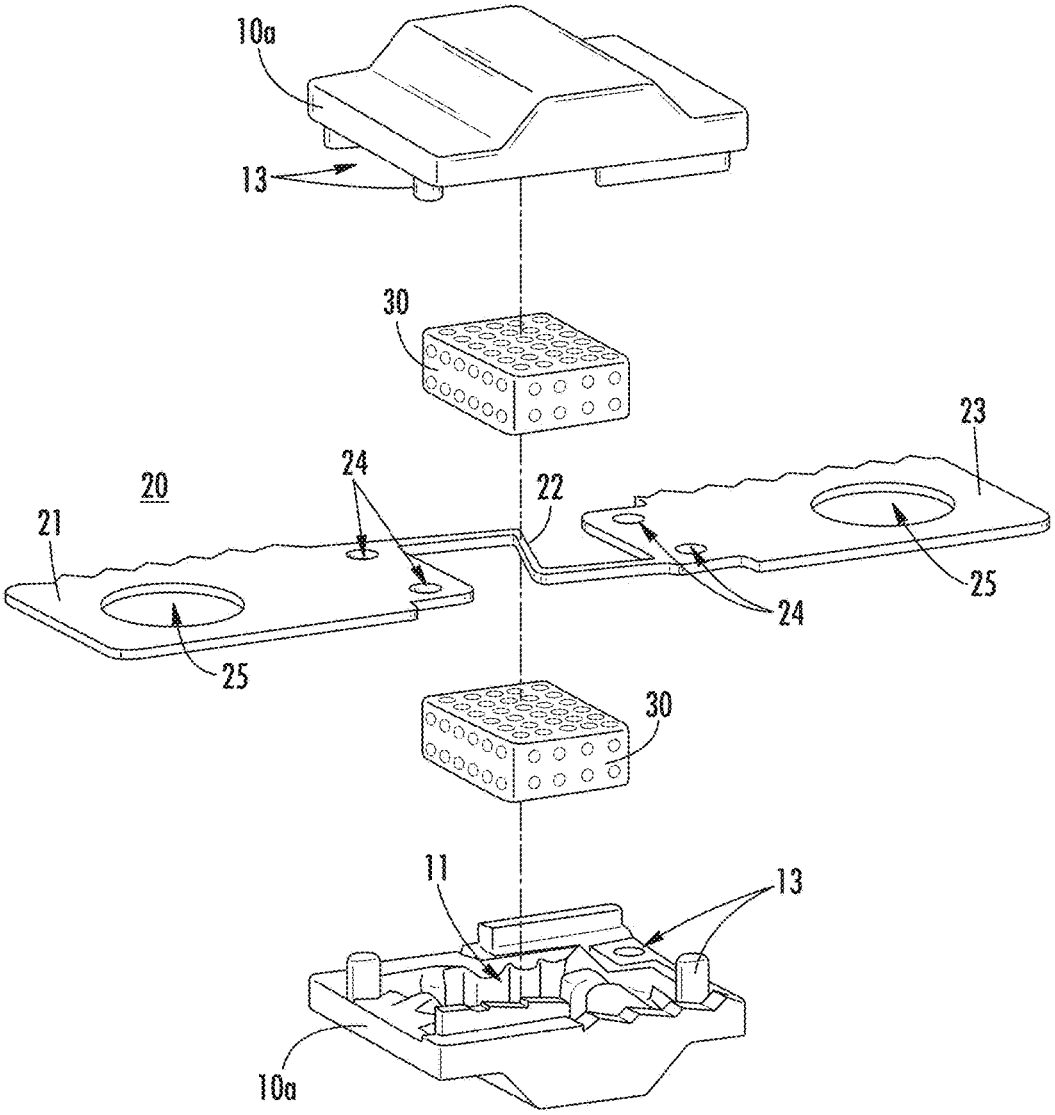
FIG. 4 is an exploded perspective view of an example of the fuse of FIG. 1 according to embodiments of the present disclosure.

FIG. 4 illustrates an exploded view of the fuse 100 according to embodiments of the present disclosure. As depicted, the fuse 100 includes housing 10*a*, porous material 30, and conductor 20. The conductor 20 includes the terminals 21, 23 and the fuse element 22. In some examples, the terminal 21 and terminal 23 may have a connection hole 25. The connection hole 25 may be configured to physically and electrically connect the fuse 100 to a source of power and circuit component. For example, the holes 25 may be configured so the fuse 100 can be secured to a bolt or post. Furthermore, the conductor 20 may have alignment holes 24. The alignment holes 24 may be configured to align with the alignment portions 13 of the housings 10*a* as the fuse 100 is assembled. The alignment holes 24 and alignment portions 13 can then retain the housing 10 over the fuse element 22 once the fuse 100 is assembled. Additionally, the alignment portions 13, when passed through the alignment holes 24 may form a structure retaining the porous material 30 centered over the fuse element 22. This may assist in ensuring substantially all or as much as desired of the vaporized material from the fuse element 22 is caught in the pores 31 (refer to FIG. 3) when the fuse element 22 melts.

In some examples, the porous material 30 may be disposed so the porous material is touching the fuse element 22. With other examples, the porous material 30 may be disposed so a space (e.g., refer to FIGS. 1 and 7) exists between the terminals 21, 23 and the porous material 30. More specifically, a space exists between the terminals 21, 23 and the porous material 30 so a carbon bridge is unlikely to build up and provide a low resistance path between terminals 21, 23. With some examples, a space between terminals 21, 23 and the porous material 30 may exist, while the porous material 30 is close to or even touches the fuse element 22.

With some examples, the porous material 30 may be configured to cool the arc during melting of the fuse element, in addition to catching vaporized material. Accordingly, the fuse 100, in addition to providing higher insulation resistance, may provide quicker arc extinction than conventional fuses.

Figure 5A:
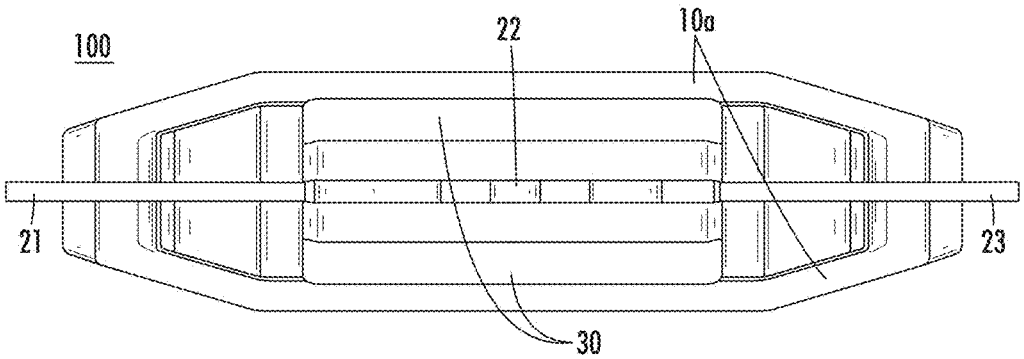
FIGS. 5*a*-5*b* are cut-away views of an example of the fuse of FIG. 1 before and after the fuse element melts according to embodiments of the present disclosure.
Figure 5B:
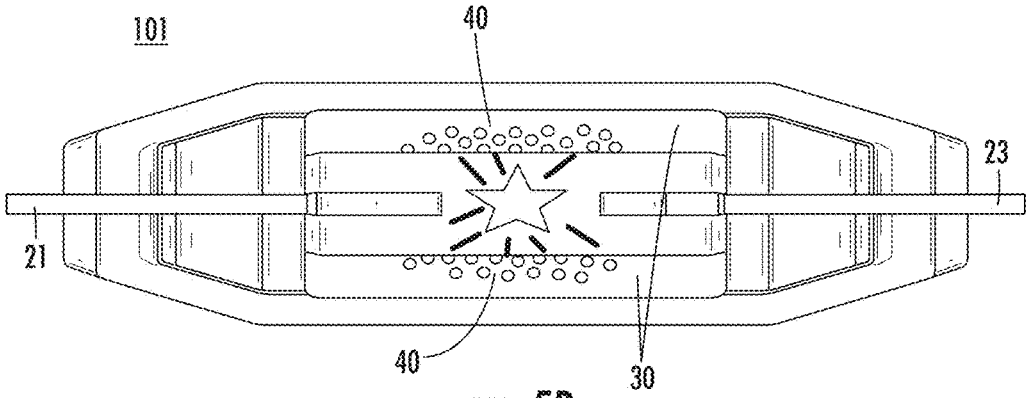

FIGS. 5*a*-5*b* illustrate a cut-away view of an example fuse, fuse 100, before and after the fuse element melts. In particular, FIG. 5*a* illustrates the fuse 100 before the fuse element 22 has melted while FIG. 5*b* illustrates the fuse 100' once the fuse element 22 has melted. As depicted, the porous material 30 is disposed in the cavity 11 of the housing 10 above and below the fuse element 22. Furthermore, the porous material 30 is centered about the fuse element 22. Terminals 21, 23 extend out from the housing 10 and provide a path for current to flow through the fuse element 22.

Once an overcurrent and/or overvoltage condition occurs, the fuse element 22 melts and vaporizes as described above. The porous material 30 catches the vaporized material 40 of the fuse element 22. In particular, the vaporized material 40 is lodged in the pores 31 of the porous material 30 and is thereby substantially prevented from depositing on the inside surface of the housing 10. Accordingly, the path for current to flow between the terminals 21, 23 is interrupted and a high (e.g., >1 MΩ for a 70V fuse, or the like) insulation resistance is provided.

In various embodiments, the porous material 30 is provide with a pore structure capturing vaporized material 40 in a manner reducing the likelihood of formation of a continuous electrically conductive path between the terminal 21 and terminal 23 after a fusing event. The porous material 30 may have a pore size distribution adapted to contain solidified particles (referred to as the vaporized material 40) formed after solidification of melted or vaporized portions of the fuse element 22. For example, the pore size of porous material 30 may range from several micrometers to several millimeters, such as between between five micrometers and five millimeters. Additionally, the porous material 30 may have a surface area five times greater than the surface area of the inside of housing 10, or ten times greater, or one hundred times greater. For a given amount of vaporized material 40, this structure of porous material 30 provides a much larger surface area to condense upon without forming a continuous layer or bridge of conductive material, as compared to a fuse formed without the porous material 30.

Figure 6:
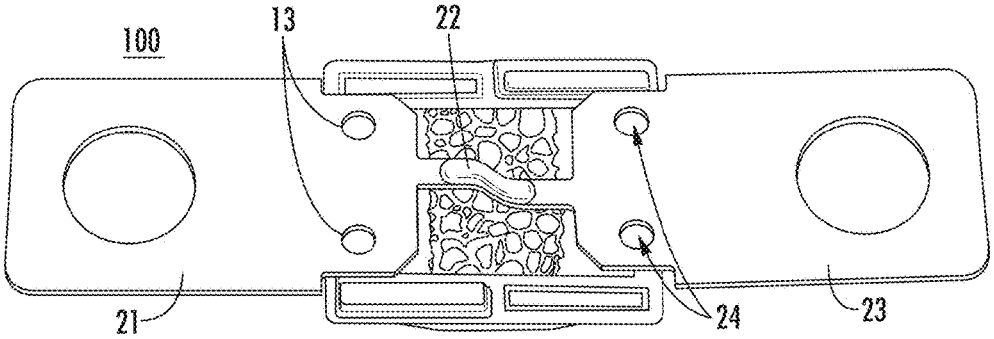
FIG. 6 is an image of an example of the fuse of FIG. 1 according to embodiments of the present disclosure.

FIG. 6 is an image of an example fuse, fuse 100, according to embodiments of the present disclosure. As depicted, terminals 21, 23 are connected to the fuse element 22 and extend out of the housing 10*a*. The alignment holes 24 are fit over the alignment portions 13 of the housing 10*a* and are configured to receive the alignment portions 13 (not shown) of another housing 10*a* (also not shown) to be assembled on the housing 10*a*. Furthermore, the porous material 30 is depicted disposed below the fuse element 22 and retained in position (e.g., substantially centered over the fuse element 22) by the alignment portions 13. In some examples, another piece of porous material 30 (not shown for clarity of illustration) may be disposed above the fuse element 22 and retained in position opposite the porous material 30 shown in FIG. 6.

Figure 7:
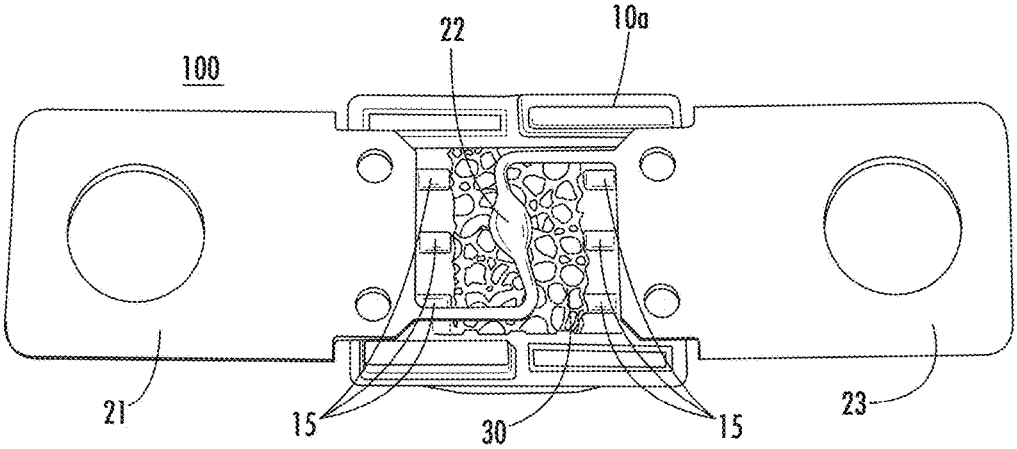
FIG. 7 is an image of an example of the fuse of FIG. 1 according to embodiments of the present disclosure.

FIG. 7 is an image of an example fuse, fuse 100, according to embodiments of the present disclosure. As depicted, the terminals 21, 23 are connected to the fuse element 22 and extend out of the housing 10*a*. The porous material 30 is inserted into the cavity 11 of the housing 10*a* between ribs 15. As depicted, the ribs 15 are positioned on either side of the porous material 30. In general, the ribs 15 may have any of a variety of shapes (e.g., ribs as shown, circular posts, or the like). The ribs 15 may be configured to support the porous material 30 during assembly (e.g., retain the material in the cavity 11) as well as support the porous material 30 after assembly and during use. In particular, where the porous material 30 is a flexible material, the porous material 30 may be sized slightly larger than the distance between the ribs. As such, when the material is inserted between the ribs, the material may be biased to push against the ribs and thereby be retained in the cavity. With some example, the porous material 30 may be spaced away from the terminals 21, 23 to prevent a carbon bridge from forming on the surface of the porous material 30 itself and providing a low resistance path between the terminals 21, 23.

In some examples, the housing 10*a* may have ribs forming a rectangular box or bed. The rectangular bed may be sized slightly smaller than the porous material 30, such as when the porous material is in an uncompressed state before assembly in the fuse 100. The porous material 30 can be compressed and inserted into the rectangular bed. Due to the characteristic of the porous material 30, during assembly in the fuse 100, the porous material may be biased to expand against the rectangular bed and thereby be retained in the rectangular bed during assembly and use.

Figure 8A:
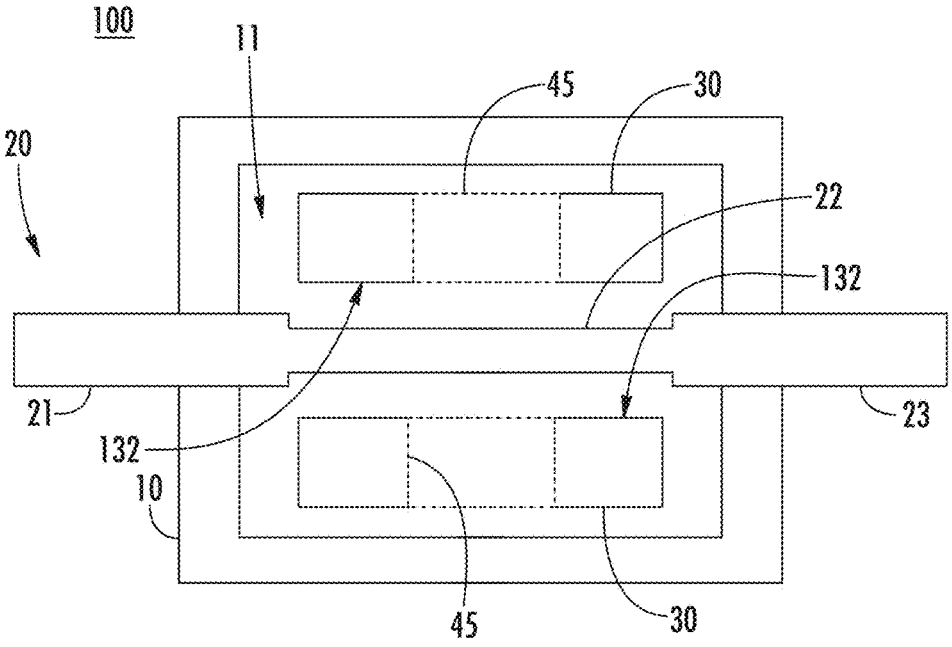
FIG. 8A is a block diagram of another embodiment of a fuse shown in a side view as in FIG. 1.
Figure 8B:
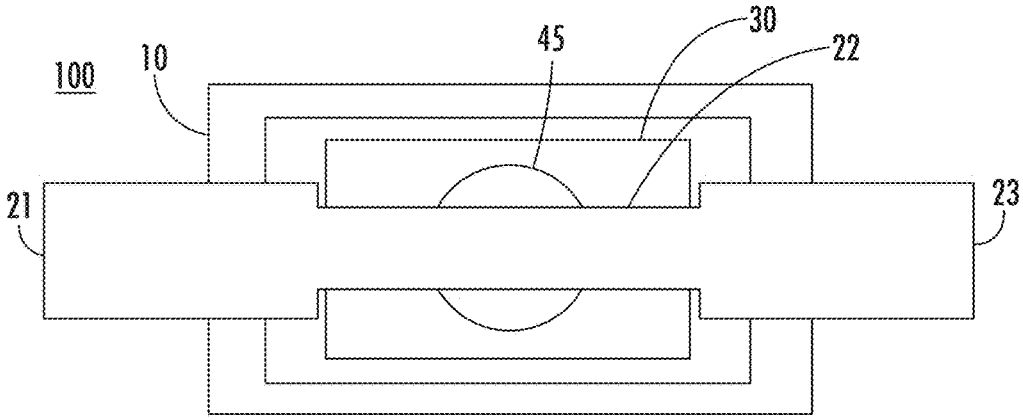
FIG. 8B is a block diagram of the fuse of FIG. 8A in top plan view, with a top piece of porous material removed for clarity.

FIG. 8A is a block diagram of another embodiment of fuse 100 shown in a side view as in FIG. 1. FIG. 8B is a block diagram of fuse 100 of FIG. 8A in top plan view, with a top piece of porous material 30 removed for clarity. In this embodiment, the fuse 100 may be similar to the embodiment of fuse 100 of FIG. 1, with a difference being the porous material 30 includes a hole 45. The hole 45 may be disposed facing the fuse element 22 and in particular a middle region where melting and or vaporization may take place during a fusing event. According to various embodiments, providing a depression, cavity, or hole within a porous material may be useful to increase capture of vaporized or melted material. In the embodiment of FIG. 8A, the hole 45 may extend through the thickness of porous material 30. In other embodiment, a depression may extend partially through the thickness of porous material 30. The embodiments are not limited in this context. The shape of the hole 45 may be circular, square, rectangular, or other convenient shape. In various embodiments, the diameter or other lateral dimension of the hole 45 may be 2 mm to 10 mm. An advantage of the embodiment of FIGS. 8A and 8B is because a depression or hole may be reproducibly located at a target location near where melting or vaporization of a fuse element 22 may take place. Thus, in addition to material captured by pores of the porous material 30, material is likely captured within hole 45 during a fusing event.

As used herein, references to "an embodiment," "an implementation," "an example," and/or equivalents is not intended to be interpreted as excluding the existence of additional embodiments also incorporating the recited features.

While the present disclosure has been made with reference to certain embodiments, numerous modifications, alterations and changes to the described embodiments are possible without departing from the sphere and scope of the present embodiments, as defined in the appended claim(s). Accordingly, the present disclosure is not to be limited to the described embodiments, but rather has the full scope defined by the language of the following claims, and equivalents thereof.

The invention claimed is:

1. A fuse, comprising:

a housing having a cavity;

a fuse element disposed within the cavity;

a plurality of terminals extending out of the housing and electrically connected to the fuse element; and porous material disposed in the cavity, the porous material having a plurality of pores, the porous material further comprising an open pore structure wherein at least some of the pores are disposed on an outer surface of the porous material facing the fuse element;

wherein the housing comprises a plurality of ribs engaging the porous material, wherein the porous material is in a compressed state when the fuse is assembled.

2. The fuse of claim 1, wherein the porous material catches vaporized material of the fuse element.

3. The fuse of claim 1, wherein the porous material is silicone foam.

4. The fuse of claim 1, wherein the porous material is disposed above and below the fuse element.

5. The fuse of claim 1, wherein the porous material comprises a pore size of between five micrometers and five millimeters.

6. The fuse of claim 1, wherein the plurality of ribs define a box having a first size, wherein the porous material has a second size in an uncompressed state greater than the first size.

7. The fuse of claim 1, wherein the housing centers the porous material about the fuse element.

8. The fuse of claim 1, wherein the plurality of terminals includes a first terminal and a second terminal, and wherein the porous material is spaced apart from the first terminal and the second terminal.

9. The fuse of claim 1, wherein the housing comprises a first portion and a second portion, wherein at least one of the first portion and the second portion includes an alignment component coupling the first portion and the second portion to one another.

10. The fuse of claim 1, wherein the porous material comprises a hole facing the fuse element.

11. The fuse of claim 1, wherein the porous material is spaced apart from the fuse element.

12. A method of forming a fuse, comprising:

providing a fuse structure comprising a fuse element and a first terminal and a second terminal connected to the fuse element;

providing a first housing part and a second housing part;

providing a porous material between the fuse element and at least one of the first housing part and the second housing part; and assembling the first housing part to the second housing part, wherein the first housing part and the second housing part define a cavity retaining the porous material, the porous material having a plurality of pores, the porous material further comprising an open pore structure wherein at least some of the pores are disposed on an outer surface of the porous material facing the fuse element;

wherein at least one of the first housing part and the second housing part comprises a plurality of ribs, wherein the assembling comprises compressing the porous material against the plurality of ribs.

13. The method of claim 12, wherein the first housing part defines a first cavity region retaining a first piece of the porous material, and wherein the second housing part defines a second cavity region retaining a second piece of porous material.

14. The method of claim 12, wherein providing the porous material comprises attaching the porous material to an inner surface of at least one of the first housing part and the second housing part.

15. The method of claim 14, wherein the porous material comprises silicone foam and the attaching comprises gluing the silicone foam to the inner surface.

16. The method of claim 12, wherein the porous material comprises a flexible material having a first size in an uncompressed state, and wherein the assembling comprises creating a second size for the cavity less than the first size, wherein the porous material is retained in the cavity in a compressed state.

17. A fuse, comprising:

a fuse element;

a first terminal connected to a first portion of the fuse element;

a second terminal connected to a second portion of the fuse element;

a housing defining a first cavity region disposed on a first side of the fuse element and a second cavity region disposed on a second side of the fuse element opposite the first side;

a first porous piece disposed in the first cavity region; and a second porous piece disposed in the second cavity region, the first porous piece and the second porous piece comprising a plurality of pores having an open pore structure wherein at least some pores are disposed on a first outer surface of the first porous piece and the second outer surface of the second porous piece, the first outer surface and the second outer surface facing the fuse element;

wherein the housing comprises a plurality of ribs engaging the first porous piece in the first cavity region and the second porous piece in the second cavity region, wherein the first porous piece and the second porous piece are in a compressed state when the fuse is assembled.

* * * * *